US010330280B2

(12) United States Patent
Armstrong

(10) Patent No.: US 10,330,280 B2
(45) Date of Patent: Jun. 25, 2019

(54) TENSION FIT FOR A BULB OF A LAMP

(71) Applicant: Patricia A. Armstrong, Wellington, OH (US)

(72) Inventor: Patricia A. Armstrong, Wellington, OH (US)

( * ) Notice: Subject to any disclaimer, the term of this patent is extended or adjusted under 35 U.S.C. 154(b) by 126 days.

(21) Appl. No.: 14/327,184

(22) Filed: Jul. 9, 2014

(65) Prior Publication Data

US 2015/0016124 A1 Jan. 15, 2015

Related U.S. Application Data

(60) Provisional application No. 61/844,092, filed on Jul. 9, 2013.

(51) Int. Cl.

| | |
|---|---|
| ***F21V 3/00*** | (2015.01) |
| ***F21V 3/02*** | (2006.01) |
| ***F21V 15/00*** | (2015.01) |
| ***F21V 17/16*** | (2006.01) |

(52) U.S. Cl.
CPC ..... *F21V 3/02* (2013.01); *F21V 15/00* (2013.01); *F21V 17/16* (2013.01)

(58) Field of Classification Search
CPC . F21V 1/14; F21V 1/143; F21V 1/146; F21V 1/26; F21V 17/16; F21V 3/02
See application file for complete search history.

(56) References Cited

U.S. PATENT DOCUMENTS

| | | | | |
|---|---|---|---|---|
| 5,083,250 | A * | 1/1992 | Malcolm | G09F 21/06 362/202 |
| 5,988,834 | A * | 11/1999 | Latzel | F21S 6/002 362/278 |
| 2004/0042216 | A1* | 3/2004 | Huang | F21V 3/023 362/363 |
| 2010/0135024 | A1* | 6/2010 | Gier | F21V 3/02 362/294 |
| 2011/0137665 | A1* | 6/2011 | Acworth | F21S 6/002 705/1.1 |
| 2011/0216540 | A1* | 9/2011 | McCafferty, Jr. | F21V 7/00 362/282 |
| 2014/0254176 | A1* | 9/2014 | Schmitt | F21V 21/002 362/362 |

* cited by examiner

*Primary Examiner* — Gerald J Sufleta, II
(74) *Attorney, Agent, or Firm* — Medley, Behrens & Lewis LLC; Lorri W. Cooper

(57) ABSTRACT

A shield for a bulb of a lighting base includes an upper portion for at least partially encircling a bulb and means for coupling the upper portion to a lighting base. Another shield includes a first portion and a second portion. The first portion at least partially encircles and protects a bulb such that if a lighting base, a bulb and the shield are dropped on a surface, a bulb cannot come into contact with a surface. The second portion is for coupling the shield to a lighting base. The first portion has a length and at least one side of the first portion, as defined along the length of the first portion, is open to the bulb.

12 Claims, 5 Drawing Sheets

TENSION FIT FOR A BULB OF A LAMP

CROSS-REFERENCE TO RELATED APPLICATION

This application claims priority to U.S. Provisional Application No. 61/844,092, filed on Jul. 9, 2013, the disclosure of which is incorporated herein by reference in its entirety.

FIELD

The present invention concerns a shield for a bulb of a lamp, such as a shield for an electric candle lamp.

BACKGROUND

Electric candle lamps are often used in windows to present an aesthetically pleasing and welcoming exterior appearance to a home during night time hours. Electric candle lamps typically include a base, a shaft that resembles a candle, and a light bulb positioned at the top of the shaft that resembles a burning candle. Electric candle lamps are often positioned on window ledges and may come in contact with curtains or blinds. The bulbs of electric candle lamps have been known to melt or turn plastic blinds a darkened color due to the heat that emanates from the bulb. This causes damage to the blind and also represents a potential fire hazard.

In addition, electric candle lamps have been known to be knocked over and displaced from their window ledges. Since the bulbs are often made of glass, they may shatter on the floor, causing a hazard to people and pets. In addition, broken bulbs may continue to receive an electrical charge since the candle lamps often remain plugged in, which can result in a fire hazard.

SUMMARY

A shield for a bulb of a lamp is disclosed and claimed.

DETAILED DESCRIPTION

The example shield 10 is for use around a light bulb 12 and is used to help deter fire hazards, to help deter the light bulb glass from shattering and/or breaking, and to add decoration to a light fixture. A light fixture that may utilize the example shield is an electric or battery powered candle lamp 14, although other types of lighting may also derive a benefit from the invention described herein.

The example shield 10 will accommodate various bulb sizes and may come in different shapes, sizes and colors. The examples shown and described herein are for illustration purposes only. The invention is not limited to the sizes and shapes shown herein.

Example colors for the shield 10 may include clear, solid, semi-clear, and fluorescent, among other colors. The shield 10 may be made of plastics, acrylics, metal, tin, aluminum, pewter, brass, iron, bronze, steel, wood, leather, copper and other materials. The shield 10 may be etched, imprinted or shaped with a design to accommodate holidays and home themes. For example, the covers may be holiday themed, such as Thanksgiving, Christmas, Valentine's Day, St. Patrick's Day, Fourth of July, or may be lifestyle themed, such as country, nautical, Tuscan, classic/contemporary, modern, biblical, American colonial, southwestern, military, or other designs. The interior surfaces or exterior surfaces of the shield 10 may be coated, if desired (not shown). For example, the interior surfaces may be coated with a reflective coating. The interior or exterior surface may be coated with an anti-reflective coating or a colored coating in order to change the color of the underlying material. The interior surfaces may be coated with a light blocking material, if desired.

Figure 2:
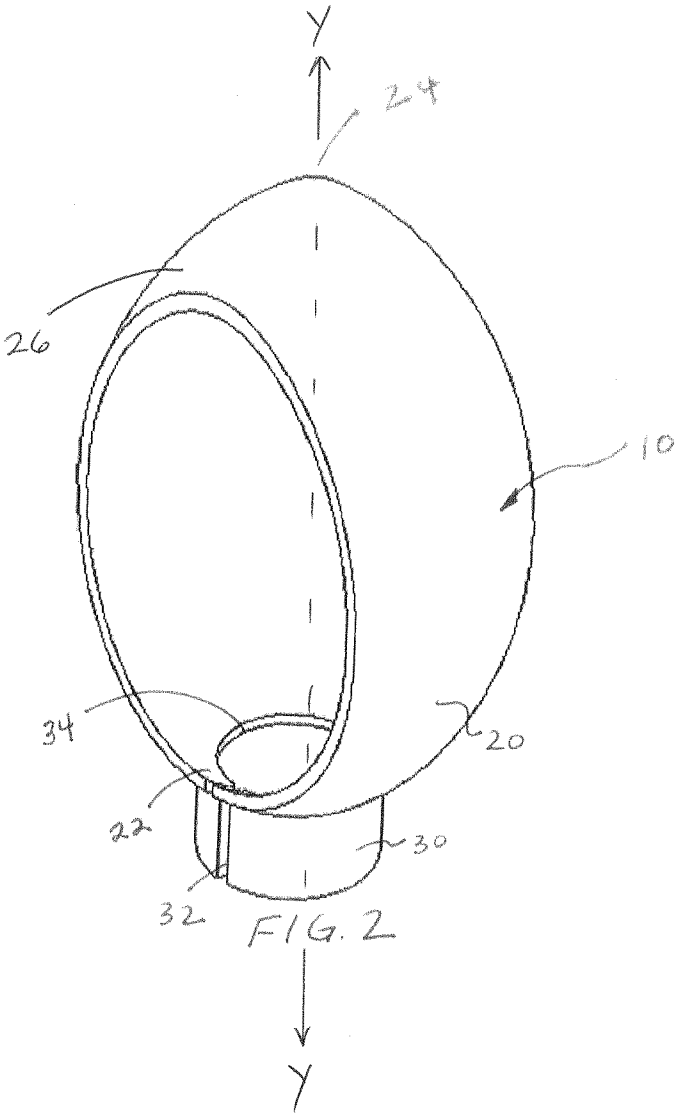
FIG. 2 is a perspective view of the example shield of FIG. 1.
Figure 1:
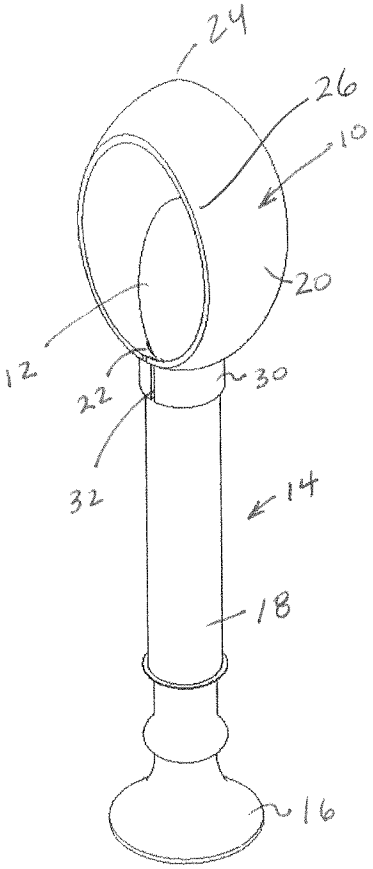
FIG. 1 is a perspective view of a candle lamp having a first example shield installed thereon.
Figure 6:
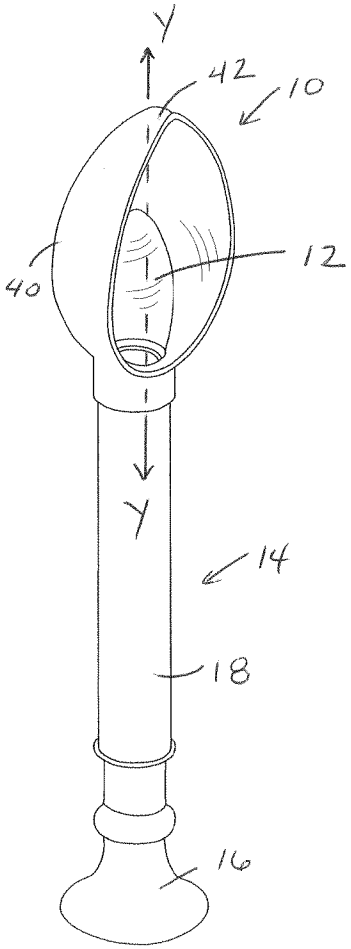
FIG. 6 is a front perspective view of the candle lamp and second example shield of FIG. 3.
Figure 5:
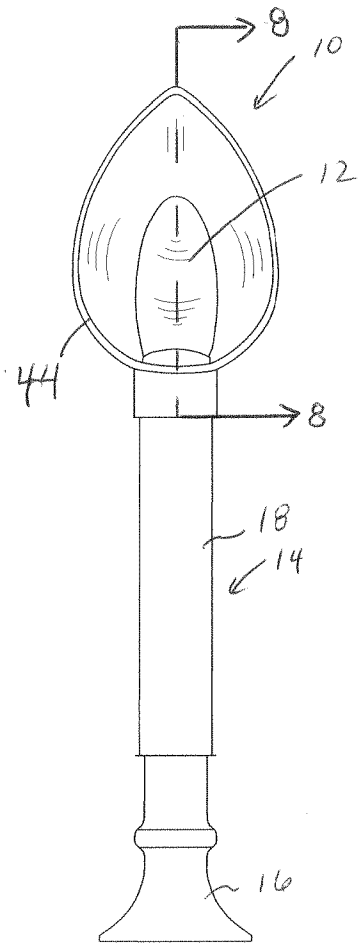
FIG. 5 is a front view, e.g., the side that faces a window, of the candle lamp and second example shield of FIG. 3.
Figure 4:
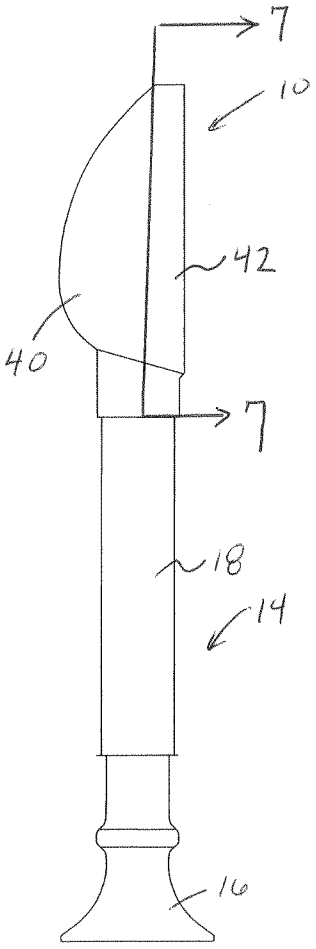
FIG. 4 is a side view of the candle lamp and second example shield of FIG. 3.
Figure 3:
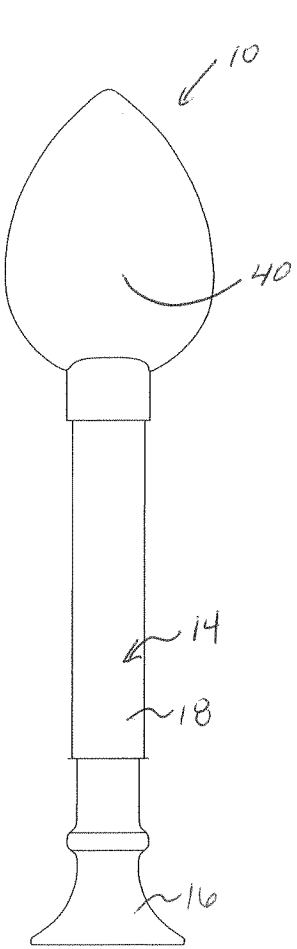
FIG. 3 is a rear view of a candle lamp and a second example shield, with the shield installed around the candle bulb.

Referring to the figures, FIGS. 1 and 2 depict a first example shield 10. FIGS. 3-8 depict a second example shield, and FIGS. 9-12 depict a third example shield, including in some cases the shield in its environment on a candle lamp 14. The candle lamp 14 may be any type of candle lamp 14. The candle lamp 14 has a base 16, a shaft 18, a candle bulb 12, and a power source (not shown). The shaft 18, as shown, is cylindrically shaped. While the examples shown herein relate to use of the example shield 10 on a candle lamp 14, other types of lamps or lighting fixtures may derive a benefit from the example shield 10. For example, the shield 10 could be used on a conventional lamp (not shown) that would normally utilize a shade. The shield 10 could be used instead of a shade, if desired. The shield 10 could be used to direct the light from the lamp 14 in a chosen direction by positioning the shield 10 in a preferred way on the lamp 14. Any type of lamp 14 or lighting fixture may be utilized with the concept of the shield 10, as described herein, and for other purposes as may be found.

FIG. 1 depicts a first example shield 10 installed on a candle lamp 14 and FIG. 2 depicts the shield in an uninstalled configuration. The shield 10 includes an upper portion 20 and a base portion 30. The upper portion resembles the shape of a candle lamp bulb, but could be other shapes. The base portion 30 is configured to seat around the top end of a shaft 18 of a candle lamp 14. The base portion 30 is generally cylindrical, or cuff-like, and includes a slit 32 that allows the base portion 30 to open and close. In the example shown, the slit 32 extends upwardly into the lower part 22 of the upper portion 20. The base portion 30 may be sized to be slightly smaller in diameter than the outer diameter of the shaft 18 in order to permit the base portion 30 to snuggly seat around and grip the shaft 18 of the candle lamp 14. The slit 32 in the base portion 30 allows the base portion 30 to expand around the shaft 18. If a different lamp 14 or lighting fixture is used, the base portion 30 of the shield 10 may seat around the socket portion of the lighting fixture (not shown) and be sized accordingly. Where a socket portion is not utilized, the base portion 30 may seat around another portion of the lamp 14 that is positioned below the bulb. In addition, the base portion 30 could be configured of a different type of expandable material that permits its use on more varied diameters, if desired.

FIGS. 3-6 depict the second example shield 10 installed on a conventional candle lamp 14. The shape of the shield 10 resembles that of the first example shield 10, but can be more easily manufactured and removed from a mold given the shape of the opening of the shield 10. In particular, in the first example shield 10, the shield 10 was substantially egg-shaped and had a circumference that was greater than one half the circumference of an egg, such that the front edge 26 of the shield 10 bent inwardly around the opening of the shield 10. In contrast, the second example shield 10 has a rear portion 40 that is substantially egg-shaped, such that half of the shield 10 is substantially egg-shaped. Then the front portion 42 of the shield 10 extends outwardly perpendicular to the longitudinal axis Y-Y of the candle lamp 14 from the largest dimension of the egg-shape in order to cover the bulb entirely, but is open at the front opening 44 in order to permit light from the bulb 12 to exit the shield 10 and for the bulb 12 to be replaced. Thus, the circumference of the front opening 44 is greater in the second example shield 10 than that of the first example shield 10. By providing the opening 44 in a perpendicularly extending fashion (with the perpendicular angle being defined from the longitudinal axis Y-Y of the length of the shield 10), as described, the part may be more readily removed from any mold during the manufacturing process. Other shapes may be used including ellipsoid, ovoid, oval, super ellipsoid, Cassini ovals, Cartesian ovals, and variations thereof, as well as other novelty shapes, the invention not being limited to a particular shape.

Figure 8:
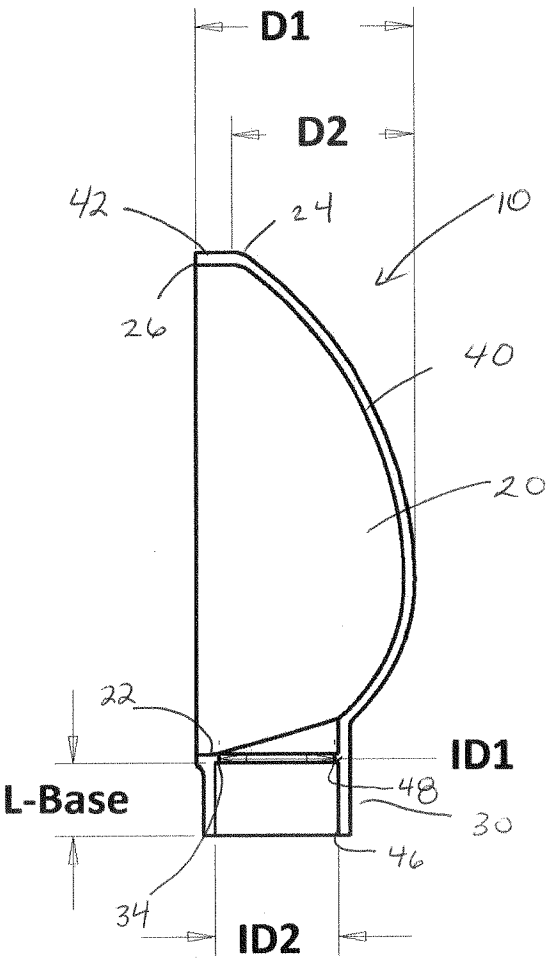
FIG. 8 is a cross-sectional side view of the second example shield, taken along line 8-8 in FIG. 3.
Figure 7:
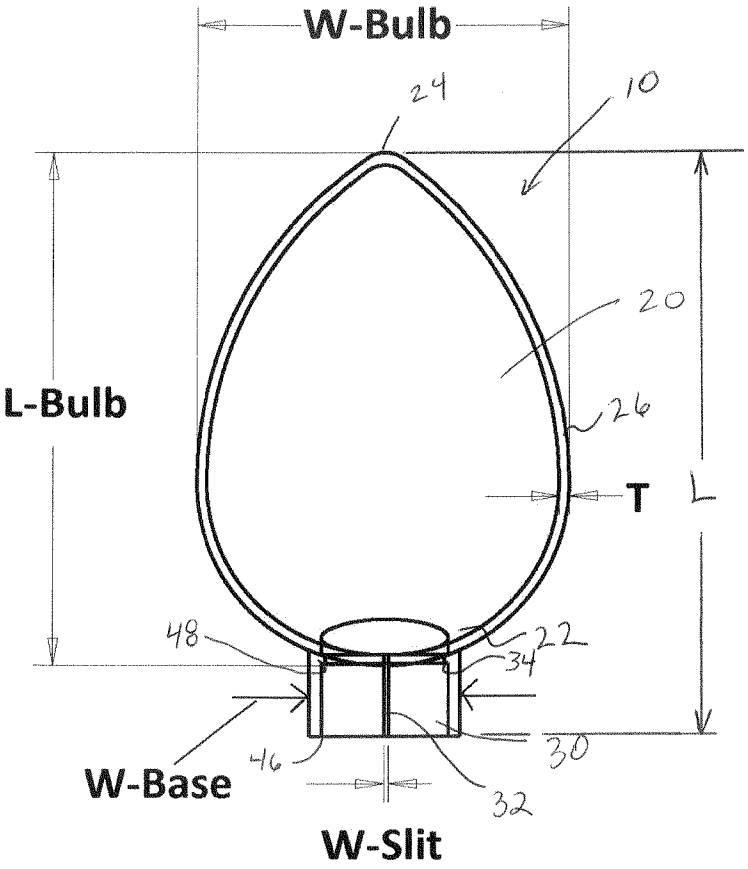
FIG. 7 is a cross-sectional front view of the second example shield, taken at line 7-7 in FIG. 4.
Figure 10:
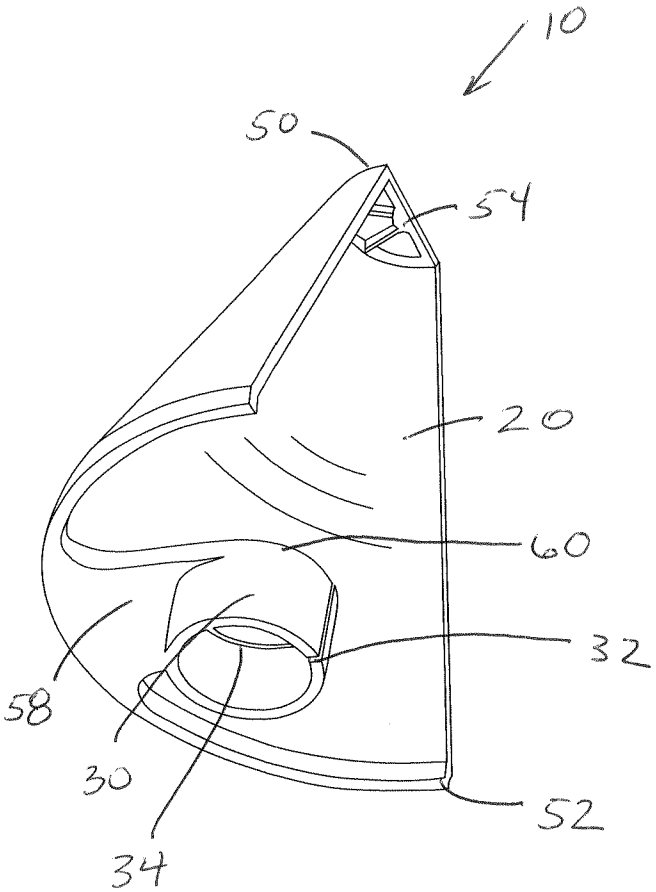
FIG. 10 is a bottom perspective view of the third example shield of FIG. 9.
Figure 9:
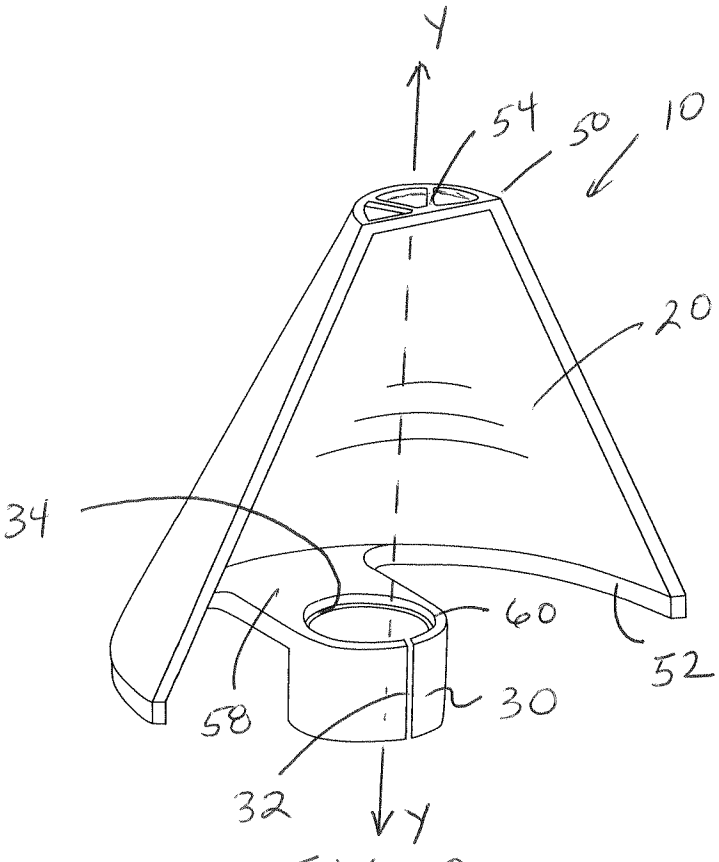
FIG. 9 is a front perspective view of a third example shield for a candle lamp.
Figure 12:
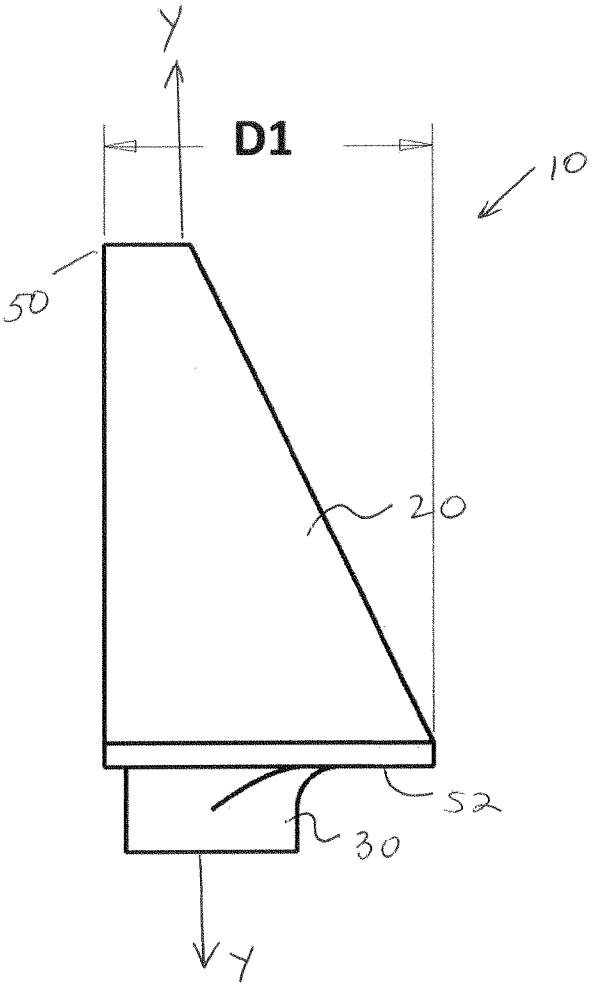
FIG. 12 is a side view of the third example shield of FIG. 9.
Figure 11:
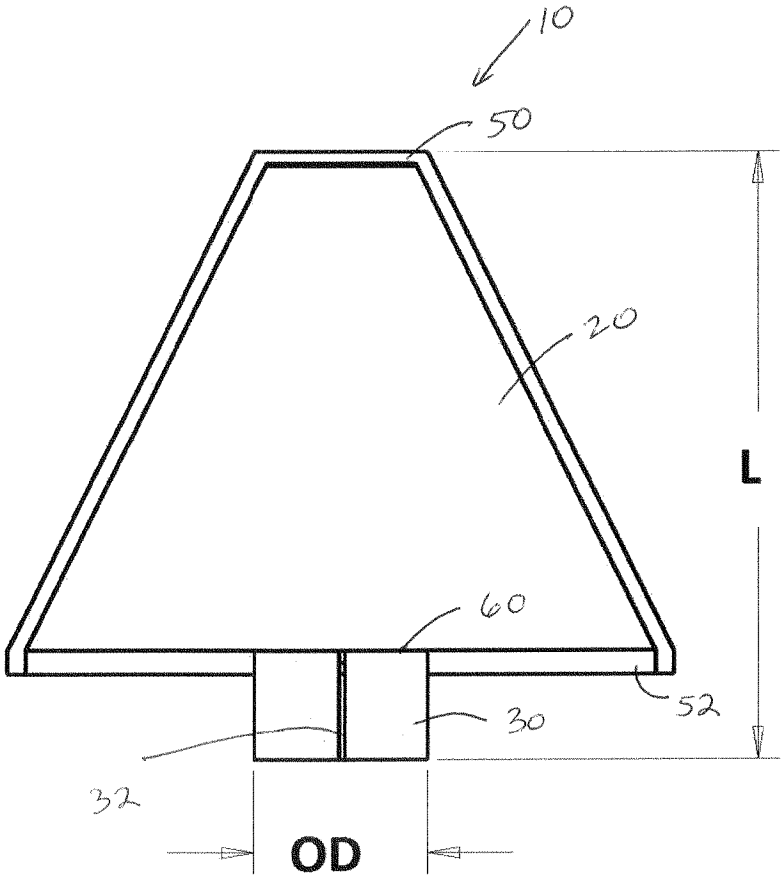
FIG. 11 is a front view of the third example shield of FIG. 9.

FIGS. 7 and 8 depict cross-sectional views of the second example shield 10 shown in FIGS. 3-6 installed on a candle lamp 14. As shown the shield 10 has an upper portion 20 and a base portion 30. The upper portion 20 is substantially egg-shaped, but could be other shapes. The base portion 30 is configured to seat around the top end of a shaft 18 of a candle lamp 14. The base portion 30 is generally cylindrical, or cuff-like, and includes a slit 32 that allows the base portion 30 to open and close. In the example shown, the slit 32 extends upwardly into the lower part 22 of the upper portion 20. The base portion 30 may be sized to be slightly smaller in diameter than the outer diameter of the shaft 18 in order to permit the base portion 30 to snuggly seat around and grip the shaft 18 of the candle lamp 14. The slit 32 in the base portion 30 allows the base portion 30 to expand around the shaft 18.

The shield 10 has a total length L, with the upper portion 20 having a length L-BULB and the base portion 30 having a length L-BASE. The upper portion 20 has a maximum width W-BULB and the base portion 30 has a width W-BASE. The base portion 30 is like a cuff in the examples shown, but could be another shape. The slit 32 in the cuff 30 has a width W-Slit. The shield 10 has a total depth D1 and a depth of the egg-shaped portion is D2. Since a perpendicular flange 42 extends outwardly from the front of the egg-shaped portion 40, D2 is typically less than D1. The walls of the shield 10 are relatively thin and have a thickness T. The upper portion 20 has a shape so that spacing is provided between the walls of the upper portion 20 and the bulb 12.

The cylindrical cuff 30 of the base portion has an inner diameter ID2 at the bottom opening 42 of the base portion 30 and the inner diameter ID2 of the cuff 30 is constant until it reaches a transition point 48 where the cuff 30 joins with the upper portion 20 of the shield 10. At the transition point 48, an inwardly extending lip 34 creates an inner diameter ID1 that is smaller than inner diameter ID2 of the cuff 30. The lip 34 is configured to rest on the top of the candle lamp shaft or cylinder 18 and helps to deter or prevent the shield 10 10 from sliding down the shaft 18 of the candle lamp 14. The lip 34 is a protruding ring that is positioned at the inner, top end of the cuff. The cuff 30 includes an open slit 32 and the inner diameter of the cuff is slightly undersized compared to the cylinder or shaft 18 of the candle lamp 14 so that the cuff stretches or bends over the shaft 18 in order to provide a tension fit to hold the shield 10 10 in position around the shaft 18, with the slit 32 providing the cuff with the ability to bend around the shaft 18. For example, if the candle shaft 18 is 0.875 inches, the cuff 30 may be 0.844 inches. Other dimensions may alternatively be used. The lip 34 is shown as being a continuous ring-shaped protrusion, but does not have to be ring-shaped or continuous. It could be other shapes.

While the base portion 30 of the shield 10 is designed to be sized so that it seats around a portion of the lamp 14 in order to hold the shield 10 in place, there may be embodiments where it is not advantageous to position the base portion 30 around a portion of the lamp 14. Thus, additional attachment mechanisms (not shown), such as, for example, clear gel sticky tabs, or other attachment mechanisms, may be used to assist in holding the base portion 30 on the lamp 14. These additional attachment mechanisms may be used in addition to or instead of the base portion 30, if desired.

FIGS. 9-12 depict an example where the shape of the shield 10 resembles a lamp shade, but is otherwise similar in design to the examples discussed above. In particular, the upper portion 20 of the lamp shade 10 is substantially a truncated cone that extends from a narrower top end 50 to a wider bottom end 52. The top truncated part of the cone 50 has a rib structure 54 to aid in maintaining the shape of the shade 10. The bottom edge 56 of the shade 10 is coupled to a base portion 30 by a rib 58 that extends perpendicular to the longitudinal axis Y-Y of the shade 10, with the longitudinal axis Y-Y being defined along the length L of the shade 10. The rib 58 is a substantially flat portion that extends from the top 60 of the base portion 30. Otherwise, the base portion 30 is as previously described in connection with FIGS. 1-8. The base portion 30 has a slit 32 extending along the length of the base portion 30. The base portion 30 also includes a protruding ridge or ledge 34 that extends inwardly from an inner surface of the base portion 30. The rib 58 that couples the base portion 30 to the lower end 52 of the shade 20 has about the same width as the outer diameter OD of the base portion 30. The rib 58 could have other widths, if desired. The open bottom end 52 of the shade 20 and the open ribbed structure 54 at the top of the shade permits hot air from the bulb 12 to be released upwardly and downwardly from the shade 20. As is evident other shapes and sizes may be utilized, other than those shown.

The shield 10 upper portion forms an enclosure that surrounds at least a portion of the bulb 12. In the examples shown, the upper portion 20 encloses more than half of the exterior of the bulb 12 such that if the candle lamp 14 were to fall onto a flat surface, such as the floor, no part of the bulb would be exposed to the flat surface. The shield 10 shown in FIGS. 1-8 has an oval or ovoid shape with a peak 24 above the top of the candle bulb 12. The upper portion 20 may conform to the shape of the bulb, or may be different from the bulb. The upper portion 20 may have a peak 24 or may be rounded or squared at the top thereof. The upper portion could be circular with a truncated portion 26 at one side. Any number of shapes may be used for the shield 10. The example upper portion 20 is shown as being solid, but could be non-solid, such as a cage (not shown). The cage could have a pattern to aid in making the shield 10 more decorative. There are embodiments where the bulb may not be covered in its entirety that fall within the scope of the claims.

A shield for a bulb of a lighting base includes an upper portion and means for coupling the upper portion to a lighting base. The upper portion is for partially encircling a bulb. The means for coupling the upper portion to a lighting base is for suspending the upper portion around a bulb so that it does not come into contact with the bulb.

The means for coupling the upper portion to a lighting base may be a base portion that is coupled to and is positioned below the upper portion. The upper portion may be open on a front side thereof. The upper portion may be closed on a rear side thereof. The upper portion may be substantially ovoid or egg-shaped and may have an open side on one side thereof and is enclosed on the other side thereof. The base portion may be substantially cylindrical. The base portion may include an attachment feature for coupling the base portion to the lighting base. The attachment feature may be a tension fit that is provided by an inner diameter that is smaller than an outer diameter of a lighting base, with the base portion including a longitudinally extending slit through the surface thereof for permitting the base portion to flex around a lighting base. The base portion may include an internal stop that permits the base portion to engage a lighting base and to remain in position on the lighting base without sliding down the lighting base.

The upper portion may be substantially solid on a part thereof that partially encircles a bulb of the lighting base. The upper portion may be made of a plastic material and the base portion may be made of a plastic material. The upper and base portions of the shield may be integrally molded into a single part. The upper portion and base portion may be fire resistant. The upper portion may be bulbous and have a larger internal diameter and height than an external diameter and height of a bulb of a lighting base. The upper portion may include a decorative treatment. The upper portion may be substantially egg shaped, egg-shaped with a peak, Cassini oval-shaped, ovoid, ellipsoid, super ellipsoid, or combinations thereof. The base portion may be coupled to the upper portion by a rib that extends perpendicular to the length of the upper portion.

The upper portion may have a truncated cone shape resembling a lamp shade, with a wider portion of the truncated cone being positioned at a bottom end of the upper portion and a narrower portion of the truncated cone being positioned at an upper end of the upper portion. An open rib structure may join the top end of the truncated cone together.

In another embodiment, a shield for a bulb of a lighting base includes a first portion for partially encircling and protecting a bulb and a second portion for coupling the shield to a lighting base. The first portion partially encircles the bulb such that if the lighting base, bulb and shield are dropped on a surface, the surface cannot come into contact with the bulb. The first portion has a length and at least one side of the first portion, as defined along the length of the first portion, is open to the bulb.

The first portion of the shield may include a first part that forms a back part of the first portion and a second part that forms a front part of the first portion. The second part may include a flange that extends at least in part substantially perpendicular to an edge of the first part and with the perpendicular direction being defined in relation to the length of the first part.

The term "substantially," if used herein, is a term of estimation. While various features are presented above, it should be understood that the features may be used singly or in any combination thereof. Further, it should be understood that variations and modifications may occur to those skilled in the art to which the claimed examples pertain. The examples described herein are exemplary. The disclosure may enable those skilled in the art to make and use alternative designs having alternative elements that likewise correspond to the elements recited in the claims. The intended scope may thus include other examples that do not differ or that insubstantially differ from the literal language of the claims. The scope of the disclosure is accordingly defined as set forth in the appended claims.

What is claimed is:

1. A shield for a bulb of a cylindrical lighting base comprising:

an upper portion for only partially encircling a bulb, said upper portion enclosed on one side and open on an opposite side, and having a bottom end; and an upstanding cylindrical base portion connected directly to the bottom end of the upper portion, said upstanding cylindrical base portion for coupling the upper portion to the cylindrical lighting base and for suspending the upper portion around the bulb so that it does not come into contact with the bulb, said upstanding cylindrical base portion being sized such that it substantially surrounds and covers a length of the cylindrical lighting base and seats on a circumference of a top end portion of the cylindrical lighting base, wherein the upstanding cylindrical base portion is substantially tubular and a longitudinally extending slit extending along an interior or an exterior length of the upstanding cylindrical base portion that permits the upstanding cylindrical base portion to flex open in order to surround the length of the cylindrical lighting base, and the upstanding cylindrical base portion is sized with a dimension that is smaller than the dimension of the top end of the cylindrical lighting base to provide a tension fit that is provided by an inner dimension that is smaller than an outer dimension of the top end of the cylindrical lighting base such that the tension fit of the upstanding cylindrical base portion provides for the upstanding cylindrical base portion to be self-supporting on the upper portion on the cylindrical lighting base, with the longitudinally extending slit of the upstanding cylindrical base portion permitting the upstanding cylindrical base portion to flex around the cylindrical lighting base, wherein the upstanding cylindrical base portion is coupled directly to the upper portion by a single rib that extends perpendicular to a length of the upper portion.

2. The shield of claim 1, wherein the upper portion is open on a front side thereof.

3. The shield of claim 1, wherein the upper portion is closed on a rear side thereof.

4. The shield of claim 1, wherein the upper portion is substantially ovoid or egg-shaped in at least some parts of the upper portion.

5. The shield of claim 1, wherein the upstanding cylindrical base portion includes an internal stop that permits the upstanding cylindrical base portion to engage the top end of the cylindrical lighting base and to remain in position on the cylindrical lighting base without sliding down the cylindrical lighting base.

6. The shield of claim 1, wherein the upper portion is substantially solid on a part thereof that partially encircles the bulb that is coupled to the cylindrical lighting base.

7. The shield of claim 1, wherein the upper portion is made of a plastic material and the upstanding cylindrical base portion is made of a plastic material.

8. The shield of claim 1, wherein the upper portion and upstanding cylindrical base portions of the shield are integrally molded into a single part.

9. The shield of claim 1, wherein the upper portion and the upstanding cylindrical base portion are fire resistant.

10. The shield of claim 1, wherein the upper portion is bulbous and has a larger internal diameter and height than an external diameter and height of the bulb that is coupled to the cylindrical lighting base.

11. The shield of claim 1, wherein the upper portion includes a decorative treatment.

12. A shield for a bulb of a cylindrical lighting base comprising:

an upper portion for only partially encircling a bulb, said upper portion enclosed on one side and open on an opposite side, and having a bottom end; and an upstanding cylindrical base portion connected directly to the bottom end of the upper portion, said upstanding cylindrical base portion for coupling the upper portion to the cylindrical lighting base and for suspending the upper portion around the bulb so that it does not come into contact with the bulb, said upstanding cylindrical base portion being sized such that it substantially surrounds and covers a length of the cylindrical lighting base and seats on a circumference of a top end portion of the cylindrical lighting base, wherein the upstanding cylindrical base portion is substantially tubular and a longitudinally extending slit extending along an interior or an exterior length of the upstanding cylindrical base portion that permits the upstanding cylindrical base portion to flex open in order to surround the length of the cylindrical lighting base, and the upstanding cylindrical base portion is sized with a dimension that is smaller than the dimension of the top end of the cylindrical lighting base to provide a tension fit that is provided by an inner dimension that is smaller than an outer dimension of the top end of the cylindrical lighting base such that the tension fit of the upstanding cylindrical base portion provides for the upstanding cylindrical base portion to be self-supporting on the upper portion on the cylindrical lighting base, with the longitudinally extending slit of the upstanding cylindrical base portion permitting the upstanding cylindrical base portion to flex around the cylindrical lighting base, wherein the upper portion has a truncated cone shape resembling a lamp shade, with a wider portion of the truncated cone shape being positioned at the bottom end of the upper portion and a narrower portion of the truncated cone shape being positioned at an upper end of the upper portion, and further comprising an open rib structure joining a top end of the truncated cone shape together.

* * * * *